US007305916B2

(12) United States Patent
Broser et al.

(10) Patent No.: US 7,305,916 B2
(45) Date of Patent: Dec. 11, 2007

(54) RECIPROCATING-PISTON MACHINE FOR MOTOR VEHICLES

(75) Inventors: Dietmar Broser, Hannover (DE); Otto Warnecke, Seesen (DE)

(73) Assignee: WABCO GmbH & Co. OHG, Hannover (DE)

( * ) Notice: Subject to any disclaimer, the term of this patent is extended or adjusted under 35 U.S.C. 154(b) by 9 days.

(21) Appl. No.: 11/339,982

(22) Filed: Jan. 25, 2006

(65) Prior Publication Data

US 2006/0196353 A1 Sep. 7, 2006

(30) Foreign Application Priority Data

Mar. 4, 2005 (DE) ..... 10 2005 009 947

(51) Int. Cl.
*F01B 9/02* (2006.01)
*F04B 35/01* (2006.01)

(52) U.S. Cl. ..... 92/179; 92/126

(58) Field of Classification Search ..... 92/179, 92/126; 74/595; 123/197.3, 197.4
See application file for complete search history.

(56) References Cited

U.S. PATENT DOCUMENTS

| | | | | |
|---|---|---|---|---|
| 2,054,321 | A * | 9/1936 | Hoferer | 403/254 |
| 4,184,463 | A * | 1/1980 | Koga et al. | 123/193.2 |
| 5,630,340 | A * | 5/1997 | Iikura | 123/197.3 |
| 5,644,969 | A * | 7/1997 | Leu et al. | 92/172 |
| 6,357,338 | B2 * | 3/2002 | Montgomery | 92/140 |
| 7,147,382 | B2 * | 12/2006 | Suzuki et al. | 384/569 |
| 7,240,758 | B2 * | 7/2007 | Korenjak et al. | 180/292 |

* cited by examiner

*Primary Examiner*—Thomas E. Lazo
(74) *Attorney, Agent, or Firm*—Kramer Levin Naftalis & Frankel LLP

(57) ABSTRACT

A piston compressor has a cylinder including a traveling piston sealed therein. A drive motor acts on a crankshaft, a drive shaft thereof being received by a bore of the crankshaft. A connecting rod provides for articulated connection of a crankshaft-journal of the crankshaft with the piston in a connecting rod bearing. The connecting rod is disposed relative to the drive shaft in an angled orientation that counteracts bowing deflection of the drive shaft that occurs during operation to protect against undesirable wear of the piston seal and of the connecting rod bearing.

16 Claims, 5 Drawing Sheets

RECIPROCATING-PISTON MACHINE FOR MOTOR VEHICLES

BACKGROUND OF THE INVENTION

The present invention generally relates to a reciprocating-piston machine, especially a piston compressor, of a motor vehicle, arranged and constructed to counteract bowing deflection of the vehicle drive shaft that can occur during operation.

In the small compressors used in motor vehicles, relatively large bowing deflections of the drive shaft can occur during operation, especially in the high-pressure range, thus producing, in the longitudinal direction of the drive shaft, a force that imposes a severe load on the piston seal and connecting rod bearing. This load can cause rapid wear of the piston seal, which is particularly evident when inexpensive cup packings are used, and of the connecting rod bearing, especially when inexpensive needle bearings are used, since the service life thereof is drastically shortened by the edge pressure caused by the bowing deflection of the drive shaft. The wear can lead to premature failure of the compressor. Heretofore, therefore, it has been the practice to use expensive components that are more wear resistant and more stable, such as piston rings for piston seals and ball bearings as connecting rod bearings.

Accordingly, there is a need for a reciprocating-piston machine, especially a piston compressor, constructed and arranged in such a way that premature failure due to drive-shaft bending is prevented and a long useful life is achieved even when inexpensive components are used.

SUMMARY OF THE INVENTION

Generally speaking, it is an object of the present invention to provide a reciprocating-piston machine, especially a piston compressor, of a motor vehicle that includes a connecting rod disposed relative to the vehicle drive shaft at an angled or inclined orientation to counteract bowing deflection of the drive shaft and reduce wear of the cup packing and needle bearing. Because of the angled or inclined orientation, a force vector that always presses the connecting rod toward the crankshaft with its journal is developed at every pressure. This has the advantage that the connecting rod can be mounted to be freely movable. The connecting rod is only slightly misaligned in the high-pressure region. The radial forces on the cup packing are decreased, whereby material abrasion becomes more uniform and wear is reduced, so that the cup packing lasts longer. Moreover, the edge forces on the needle bearing are decreased, so that its useful life is prolonged. The full angled or inclined orientation is still present in the low-pressure region, but since the compressive forces originating from the drive shaft are essentially zero, the needle-bearing sleeve moves practically without being subjected to radial forces.

The angled orientation between connecting rod and drive shaft is preferably achieved by a slanted crankshaft bore for the drive shaft. Bending of the drive shaft can also be compensated by a slanted orientation of the drive shaft, by a slanted orientation of the crankshaft-journal bore in the crankshaft, by a slanted orientation of the cylindrical housing-block bore for the piston or by a slanted orientation of the bearing bore in the connecting rod for the crankshaft-journal.

Still other objects and advantages of the present invention will in part be obvious and will in part be apparent from the specification.

The present invention accordingly comprises the features of construction, combination of elements, and arrangements of parts which will be exemplified in the construction hereinafter set forth, and the scope of the invention will be indicated in the claims.

BRIEF DESCRIPTION OF THE DRAWINGS

For a fuller understanding of the present invention, reference is had to the following description taken in connection with the accompanying drawings, in which.

DETAILED DESCRIPTION OF THE PREFERRED EMBODIMENTS

Figure 1:
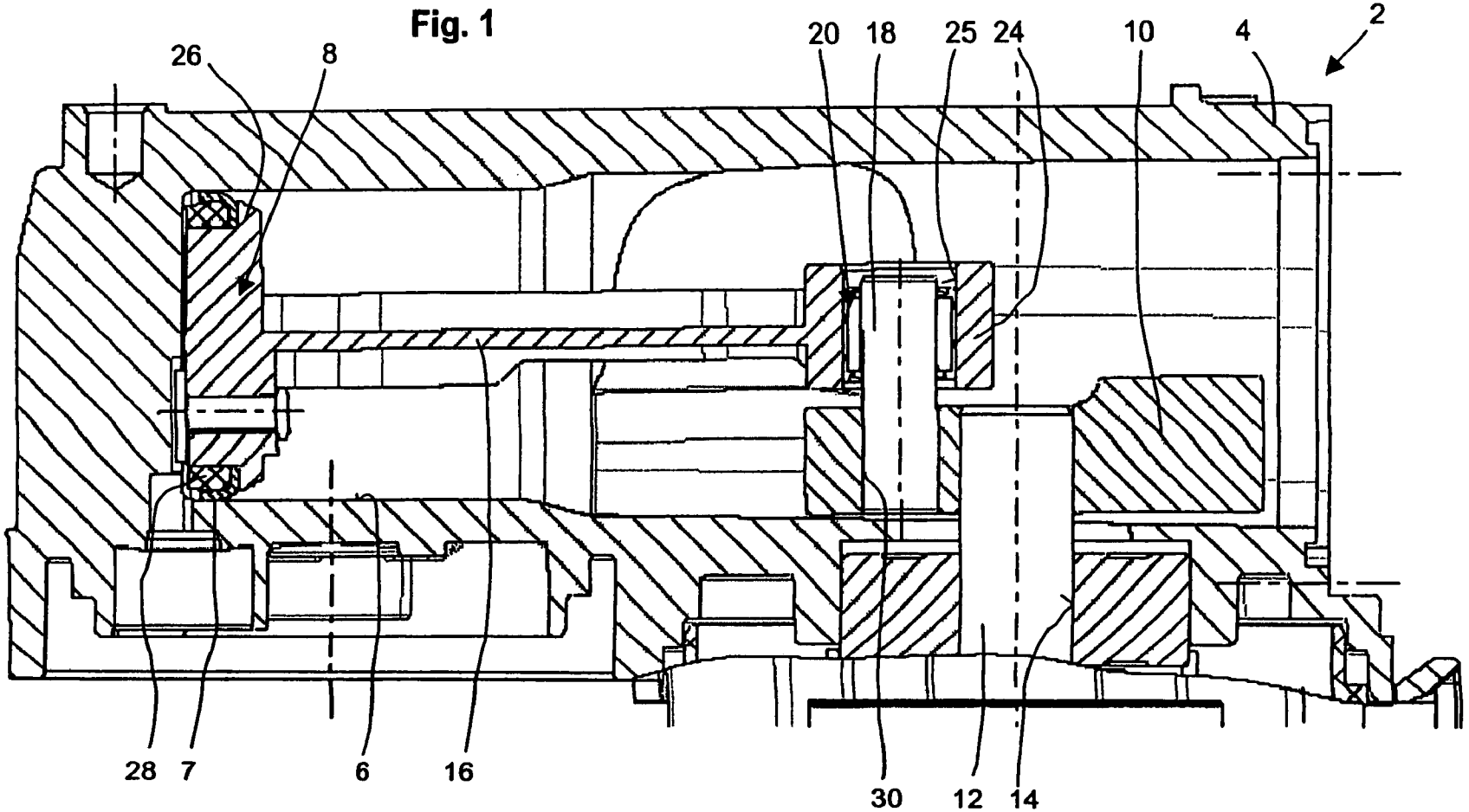
FIG. 1 is a schematic diagram of part of a compressor constructed and arranged in accordance with a preferred embodiment of the present invention showing a piston at top dead point.
Figure 2:
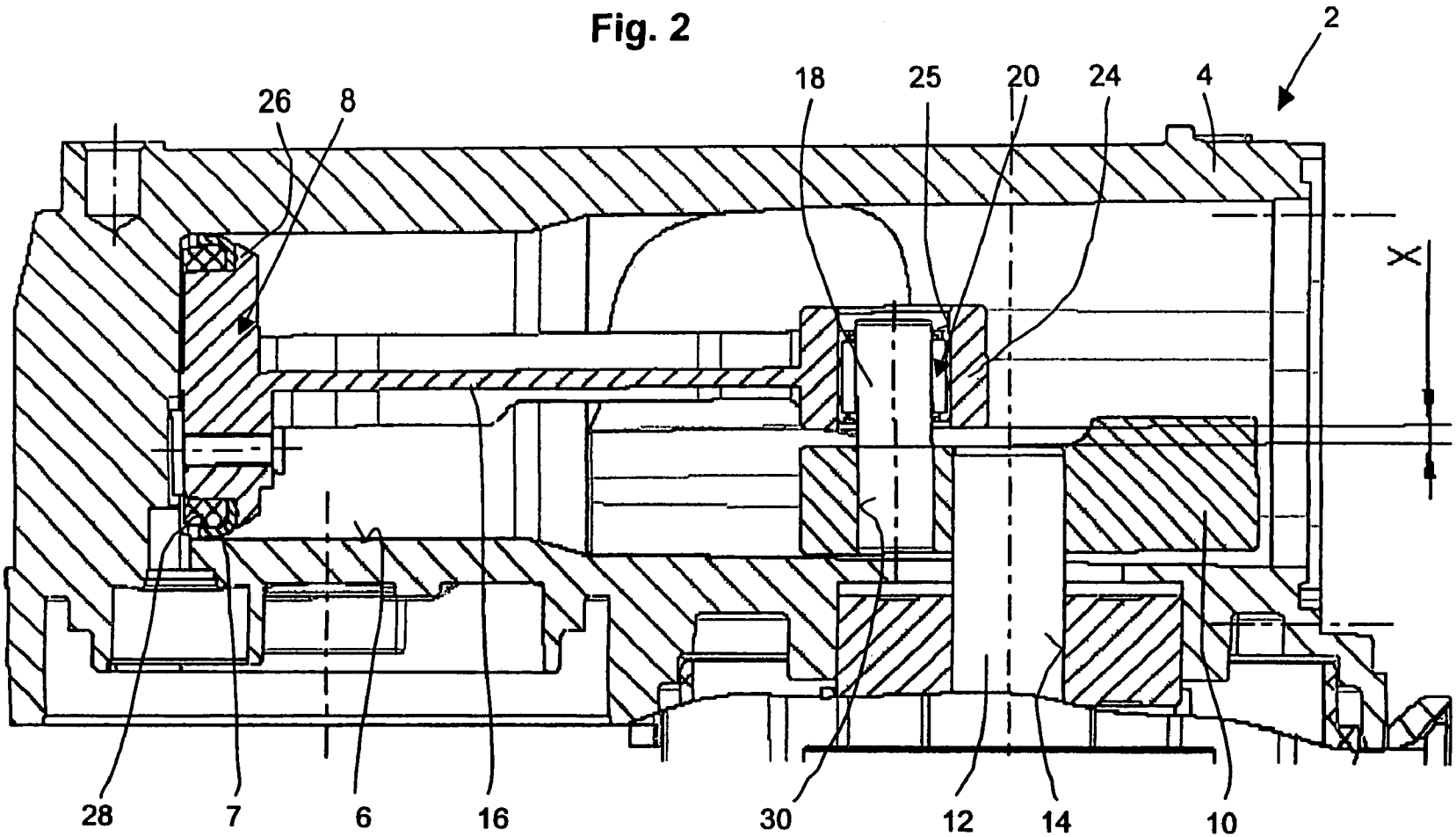
FIG. 2 is a schematic diagram of the part of the compressor depicted in FIG. 1 illustrating operation in lower pressure range.
Figure 3:
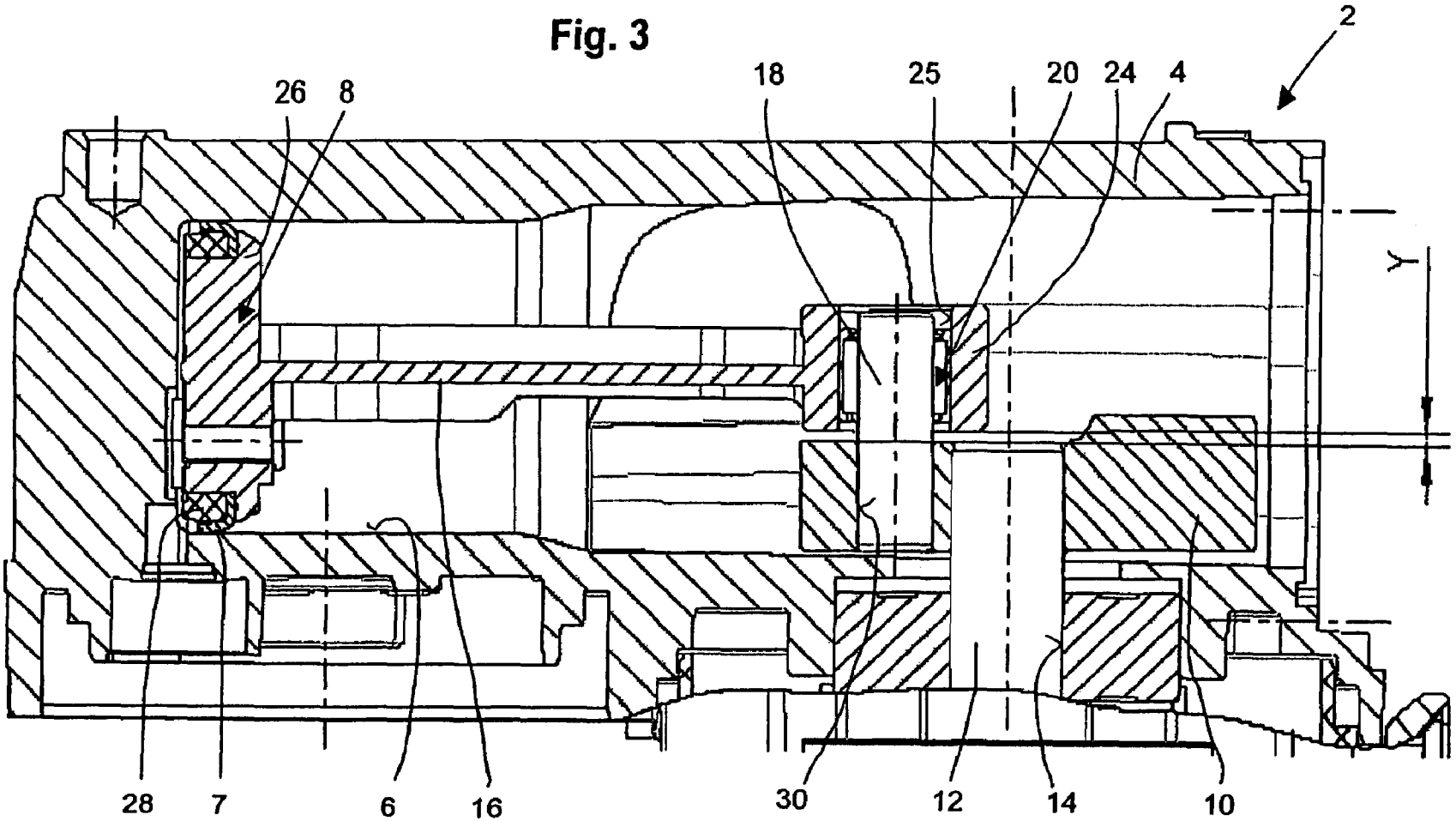
FIG. 3 is a schematic diagram of the part of the compressor depicted in FIG. 1 illustrating operation in higher pressure range.

Referring to the drawing figures, where like reference numerals are used for corresponding parts, there is shown in FIGS. 1-3 a compressor 2 with a housing-block 4, with a cylinder 6 in the form of a housing-block bore, with a traveling piston 8 sealed by means of an elastomeric seal, such as, for example, a piston-ring seal or a cup packing 7, in cylinder 6, with a drive motor (not illustrated) acting on a crankshaft 10, drive shaft 12 thereof being received by a bore 14 of crankshaft 10, and with a connecting rod 16 for articulated connection of a crankshaft-journal 18 of crankshaft 10 with piston 8 in a connecting rod bearing such as, for example, a sliding bearing, a ball bearing or a needle bearing 20. Preferably, piston 8 is formed in one piece with connecting rod 16.

FIG. 1 shows piston 8 at top dead point. FIG. 2 shows piston 8 at top dead point at low pressure. FIG. 3 shows piston 8 at top dead point at high pressure.

Figure 5:
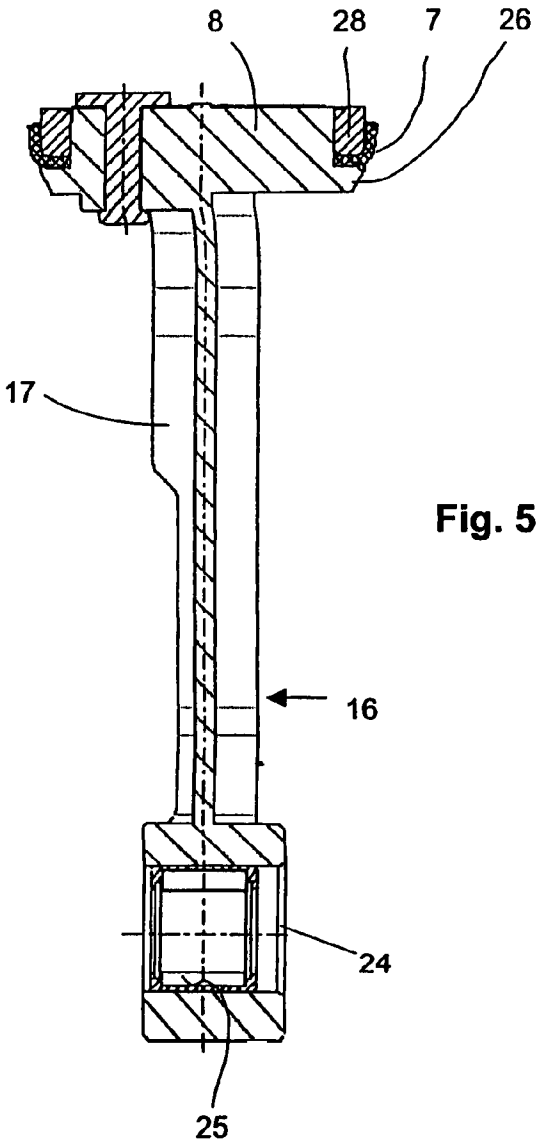
FIG. 5 is a cross-sectional view A-A taken through the connecting rod depicted in FIG. 4.
Figure 4:
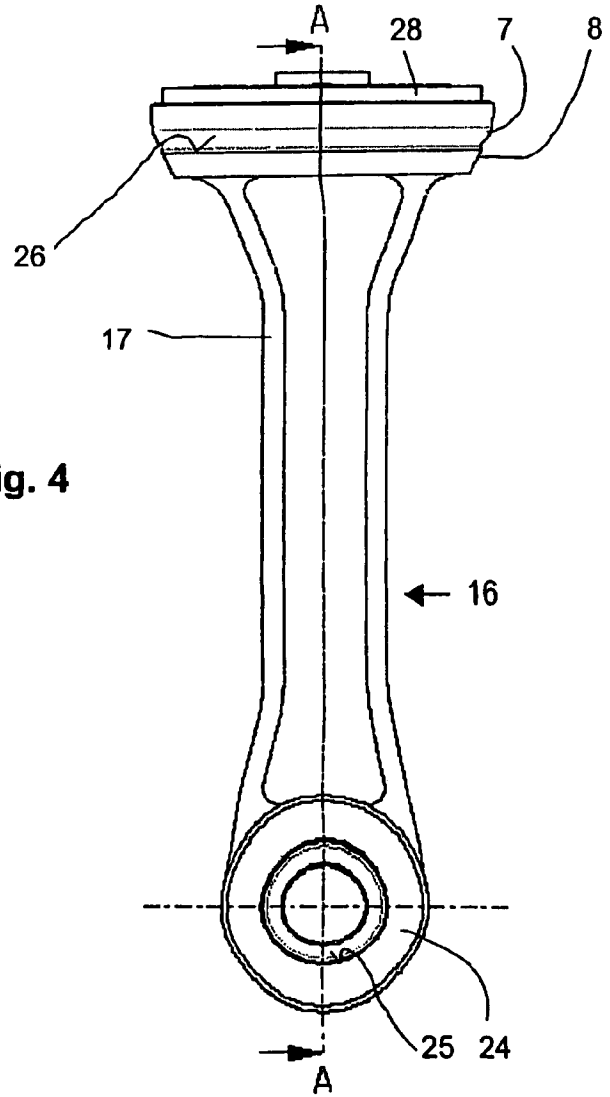
FIG. 4 is an enlarged view of a connecting rod used in the compressor constructed and arranged in accordance with a preferred embodiment of the present invention.

Connecting rod 16, which is illustrated in more detail in FIGS. 4 and 5, is provided with a connecting rod shank 17, at one end of which there is disposed the integrally joined disk-shaped piston 8 and at the other end of which there is provided a connecting rod bearing eye 24 with bearing bore 25, which receives bearing (e.g., needle bearing) 20 and therein crankshaft-journal 18. Needle bearing is axially movable on crankshaft-journal 18.

Piston 8 is provided with a circumferential step 26, onto which seal (e.g., cup packing) 7 is pressed by means of a clamping ring 28.

FIGS. 6-9 show crankshaft 10 with bore 14 for drive shaft 12 and with a bore 30 for receiving crankshaft-journal 18.

Figure 8:
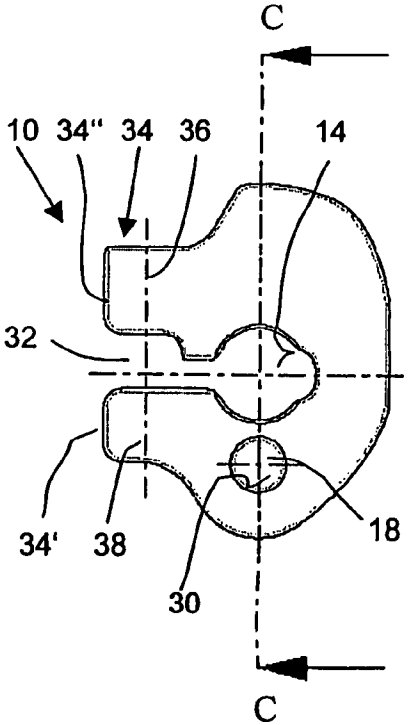
FIG. 8 is a side view of a crankshaft used in the compressor constructed and arranged in accordance with a preferred embodiment of the present invention showing an inserted crankshaft-journal.
Figure 9:
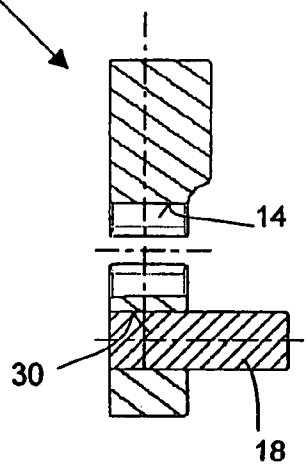
FIG. 9 is a cross-sectional view C-C taken through the crankshaft depicted in FIG. 8.
Figure 6:
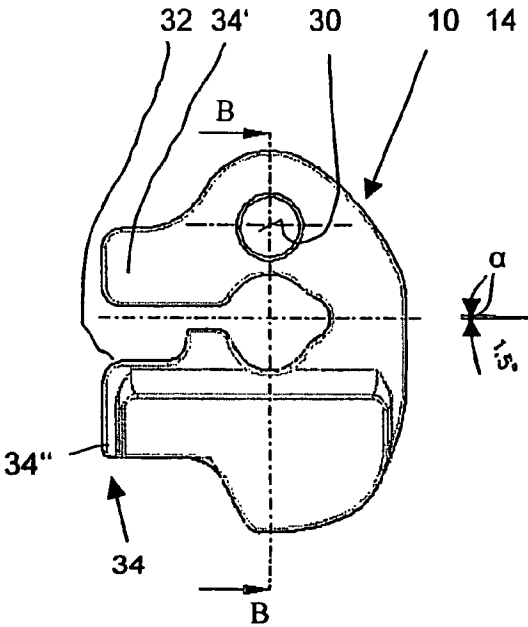
FIG. 6 is a side view of a crankshaft used in the compressor constructed and arranged in accordance with a preferred embodiment of the present invention.

Crankshaft 10 is provided with a flange 34 split by a slot 32 into two flange parts 34'; 34" (see FIGS. 6 and 8). Flange parts 34' and 34" are provided with mutually aligned bores 36, 38 (see FIG. 8) for receiving a fastener (such as, for example, a clamping bolt (not illustrated)) for clamping drive shaft 12.

Figure 7:
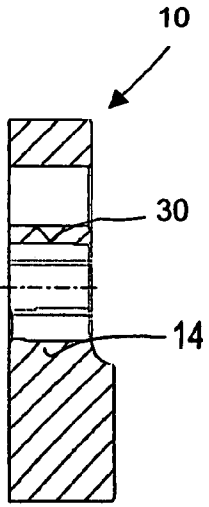
FIG. 7 is a cross-sectional view B-B taken through the crankshaft depicted in FIG. 6.

To compensate for the bending of the drive shaft that can occur during operation, bore 14 in crankshaft 10 for drive shaft 12 is formed with an inclination equal to an angle $\alpha$ (preferably, $0.0° < \alpha \leqq 1.5°$) relative to the normal, as shown in FIG. 7, so that drive shaft 12 has an angled orientation $\alpha$ relative to connecting rod 16, and a corresponding inclined orientation, which counteracts the bending of the drive shaft, is imposed on the connecting rod.

The angled orientation between connecting rod 16 and drive shaft 12 is preferably achieved by a slanted crankshaft bore 14 for the drive shaft. Bending of drive shaft 12 can also be compensated by a slanted orientation of the drive shaft, by a slanted orientation of crankshaft-journal bore 30 in crankshaft 10, by a slanted orientation of cylindrical housing-block bore 6 for piston 8 or by a slanted orientation of bearing bore 25 in connecting rod 16 for crankshaft-journal 18.

Because of the angled or inclined orientation, a force vector that always presses connecting rod 16 toward crankshaft 10 with its journal 18 is developed at every pressure. This has the advantage that connecting rod 16 can be mounted to be freely movable. Connecting rod 16 is only slightly misaligned in the high-pressure region. The radial forces on seal (e.g., cup packing) 7 are decreased, whereby material abrasion becomes more uniform and wear is reduced, so that the seal lasts longer. Moreover, the edge forces on bearing (e.g., needle bearing) 20 are decreased, so that its useful life is prolonged. The full angled or inclined orientation is still present in the low-pressure region, but since the compressive forces originating from drive shaft 12 are essentially zero, the bearing (e.g., needle bearing) sleeve moves practically without being subjected to radial forces.

For example, when, during operation of a small compressor for a motor vehicle in the high-pressure range (for example, 16 bar), a crank angle or connecting rod tilt angle of approximately 0.55° develops due to bending of the drive shaft, in turn causing a displacement X of the connecting rod (as illustrated in FIG. 2), this crank angle or connecting rod tilt angle is reduced to approximately 0.1° when bore 14 for drive shaft 12 has an orientation angled or inclined by the angle $\alpha$, and connecting rod 16 is displaced by Y (as illustrated in FIG. 3). This assumes that a value of $\geqq 0.55°$ is chosen for $\alpha$, with the result that the radial forces on seal (e.g., cup packing) 7 and the edge forces on bearing (e.g., needle bearing) 20 become negligibly small.

In the lower pressure range (toward zero bar), practically no drive-shaft bending occurs; nevertheless, the angle $\alpha$ is still present because of the angled orientation. This does not have a negative effect, however, since the compressive forces in this lower pressure range are practically zero and thus no additional load is imposed on seal (e.g., cup packing) 7 and bearing (e.g., needle bearing) 20.

It should be understood by those of ordinary skill in the art that, instead of being driven directly by the electric motor as in the foregoing, the compressor can also be driven by a belt drive, or in other words indirectly via the electric motor. In this case the compressor is driven via a drive shaft associated with a belt pulley.

Accordingly, the present invention provides a reciprocating-piston machine, especially a piston compressor, of a vehicle constructed and arranged in such a way that premature failure due to drive-shaft bending is prevented and a long useful life is achieved even when inexpensive components (e.g., cup packings, needle bearings) are used.

It will thus be seen that the objects set forth above, among those made apparent from the preceding description, are efficiently attained, and since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A reciprocating-piston machine comprising a cylinder, a traveling piston disposed in said cylinder, an elastomeric seal for sealing said piston relative to said cylinder, a crankshaft, said crankshaft including a bore defined therein and a crankshaft-journal, a drive shaft received by said crankshaft bore, and a connecting rod for articulated connection of said crankshaft-journal with said piston in a connecting rod bearing, said connecting rod being disposed at an angle relative to an axis of said drive shaft for counteracting deflection of said drive shaft.

2. The reciprocating-piston machine according to claim 1, further comprising a housing-block, and a housing-block bore defining said cylinder, and wherein said housing-block bore is inclined to effect said angle of said connecting rod relative to said drive shaft.

3. The reciprocating-piston machine according to claim 1, wherein said connecting rod includes a bearing eye having a bearing bore defined therein, and wherein said bearing bore is inclined to effect said angle of said connecting rod relative to said drive shaft.

4. The reciprocating-piston machine according to claim 1, wherein said seal is a cup packing.

5. The reciprocating-piston machine according to claim 4, wherein said piston includes a circumferential step and said cup packing is fixed by a clamping ring on said circumferential step.

6. The reciprocating-piston machine according to claim 1, wherein said seal is a piston-ring seal.

7. The reciprocating-piston machine according to claim 1, wherein said piston is integral with said connecting rod.

8. A reciprocating-piston machine comprising a cylinder, a traveling piston sealed in said cylinder, a crankshaft, said crankshaft including a bore defined therein and a crankshaft-journal, a drive shaft received by said crankshaft bore, and a connecting rod for articulated connection of said crankshaft-journal with said piston in a connecting rod bearing, said connecting rod being disposed at an angle relative to an axis of said drive shaft for counteracting deflection of said drive shaft, said crankshaft bore being inclined to effect said angle of said connecting rod relative to said drive shaft.

9. A reciprocating-piston machine comprising a cylinder, a traveling piston sealed in said cylinder, a crankshaft, said crankshaft including a bore defined therein and a crankshaft-journal, a drive shaft received by said crankshaft bore, and a connecting rod for articulated connection of said crankshaft-journal with said piston in a connecting rod bearing, said connecting rod being disposed at an angle relative to an axis of said drive shaft for counteracting deflection of said drive shaft, said drive shaft being disposed in an inclined orientation to effect said angle of said connecting rod relative to said drive shaft.

10. The reciprocating-piston machine according to claim 9, wherein said angle is of a magnitude between 0° and 1.5° inclusive.

11. A reciprocating-piston machine comprising a cylinder, a traveling piston sealed in said cylinder, a crankshaft, said crankshaft including a bore defined therein and a crankshaft-journal, a drive shaft received by said crankshaft bore, and a connecting rod for articulated connection of said crankshaft-journal with said piston in a connecting rod bearing, said connecting rod being disposed at an angle relative to an axis of said drive shaft for counteracting deflection of said drive shaft, said crankshaft-journal having a crankshaft-journal bore defined therein, and said crankshaft-journal bore being inclined to effect said angle of said connecting rod relative to said drive shaft.

12. A reciprocating-piston machine comprising a cylinder, a traveling piston disposed in said cylinder, an elastomeric seal for sealing said piston relative to said cylinder, a crankshaft, said crankshaft including a bore defined therein and a crankshaft-journal, a drive shaft received by said crankshaft bore, and a connecting rod for articulated connection of said crankshaft-journal with said piston in a needle bearing, said connecting rod being disposed at an angle relative to an axis of said drive shaft for counteracting deflection of said drive shaft.

13. The reciprocating-piston machine according to claim 12, wherein said needle bearing is axially movable on said crankshaft-journal.

14. A reciprocating-piston machine comprising a cylinder, a traveling piston disposed in said cylinder, an elastomeric seal for sealing said piston relative to said cylinder, a crankshaft, said crankshaft including a bore defined therein and a crankshaft-journal, a drive shaft received by said crankshaft bore, and a connecting rod for articulated connection of said crankshaft-journal with said piston in a sliding bearing, said connecting rod being disposed at an angle relative to an axis of said drive shaft for counteracting deflection of said drive shaft.

15. A reciprocating-piston machine comprising a cylinder, a traveling piston disposed in said cylinder, an elastomeric seal for sealing said piston relative to said cylinder, a crankshaft, said crankshaft including a bore defined therein and a crankshaft-journal, a drive shaft received by said crankshaft bore, and a connecting rod for articulated connection of said crankshaft-journal with said piston in a ball bearing, said connecting rod being disposed at an angle relative to an axis of said drive shaft for counteracting deflection of said drive shaft.

16. A reciprocating-piston machine comprising a cylinder, a traveling piston sealed in said cylinder, a crankshaft, said crankshaft including a bore defined therein and a crankshaft-journal, a drive shaft received by said crankshaft bore, and a connecting rod for articulated connection of said crankshaft-journal with said piston in a connecting rod bearing, said connecting rod being disposed at an angle relative to an axis of said drive shaft for counteracting deflection of said drive shaft, said crankshaft further including a flange having a slot defined therein, said slot separating said flange into first and second flange parts, said first and second flange parts having associated aligned first and second bores defined therein for receiving a fastener for clamping said drive shaft.

* * * * *